US005716306A

United States Patent [19]

Gallay

[11] Patent Number: 5,716,306

[45] Date of Patent: Feb. 10, 1998

[54] FREE WEIGHT SELF SPOTTING APPARATUS

[76] Inventor: Sherman Gallay, 9227 Sly Hill Rd., Ava, N.Y. 13303

[21] Appl. No.: 738,202

[22] Filed: Oct. 25, 1996

[51] Int. Cl.[6] ..... A63B 21/072

[52] U.S. Cl. ..... 482/104; 482/106; 482/108; 24/134 P

[58] Field of Search ..... 482/104, 106, 482/107, 108, 139; 24/134 P

[56] References Cited

U.S. PATENT DOCUMENTS

| | | | |
|---|---|---|---|
| 506,441 | 10/1893 | Pugsley | 24/134 P |
| 4,216,959 | 8/1980 | Niles | 482/104 |
| 4,253,662 | 3/1981 | Podolak | 482/104 |
| 4,561,651 | 12/1985 | Hole . | |
| 4,757,998 | 7/1988 | Landin . | |
| 4,799,674 | 1/1989 | Ochab . | |
| 4,998,721 | 3/1991 | Anders et al. | 482/104 |
| 5,215,510 | 6/1993 | Baran . | |
| 5,273,506 | 12/1993 | Dawson, Jr. . | |

*Primary Examiner*—Richard J. Apley
*Assistant Examiner*—Victor K. Hwang

[57] ABSTRACT

An exercise apparatus for assisting a person to safely do free weight lifting exercises without the aid of a human assistant. The apparatus is comprised of a pair of vertical cables secured at their upper ends to an overhead support structure, such structure dependent on the physical environment at the apparatus location, e.g. ceiling beams and trusses, weight-lifting frames. The lower ends of the cables are not secured. A pair of clamp assemblies telescope over the cables and the weight bar is secured to the clamp assemblies. A control bar, parallel, above and proximate to the weight bar, connects to clamp assemblies. The control bar causes the clamp assemblies to grip and release the cables. When doing an exercise, the user squeezes the control bar towards the weight bar to release the cables. To terminate the exercise the user releases the control bar which in turn causes the clamp assemblies to grip the cables and therefore support the weight bar. When an exercise is in progress the cables move freely through the clamp assemblies and therefore do not exert any forces on the weight bar, and do not constrain the movement of the weight bar in any axis. Therefore exercises done with this apparatus are true free weight exercises.

8 Claims, 4 Drawing Sheets

FREE WEIGHT SELF SPOTTING APPARATUS

BACKGROUND—FIELD OF INVENTION

This invention relates to weight lifting apparatus, specifically to such apparatus used to assist and protect weight lifters when doing barbell exercises without the assistance of another.

BACKGROUND—DESCRIPTION OF PRIOR ART

A popular and common type of weight exercise is free weight lifting. In free weight lifting the lifter lifts and controls the weight independent of any support or movement constraints imposed by apparatus or machines. There are inherent dangers to the lifter should the lifter lose control of the weight, hence lifters frequently enlist the assistance of another to intervene should the lifter lose control of the weight, and to provide assistance in starting and completing the exercise. The term used for the human assistant is "spotter" and the spotter's activity is called "spotting". In common circumstances the weight lifter must or prefers to exercise without a spotter, and therefore benefits from mechanical devices that can provide the safety and assistance that would be provided by a human spotter.

Many prior inventions have been proposed and are employed to provide spotting assistance to the free weight lifter. One category provides static mechanical stops on weight benches or weight lifting racks to prevent an out of control barbell from contacting the lifters body. U.S. Pat. No. 4,757,998 to Landing discloses fixed supporting bars attached to a weight bench that prevent the barbell from descending low enough to contact the lifters body. U.S. Pat. No. 4,799,674 discloses a pair of stands that connect to each end of the barbell to prevent it from going lower than a predetermined position. These devices permit true free weight lifting and provide protection to the free weight lifter, but only to the extent that a dropped or out of control barbell will not fall below a predetermined vertical position. They cannot provide assistance at any point in the exercise above that position.

U.S. Pat. No. 4,561,651 to Hole discloses a weight lifting machine wherein a barbell is suspended by cables which in turn connect to adjustable stops. The stops prevent the barbell from descending below a user determined level. This machine does not allow the user to terminate the exercise at any point other than with the barbell in the fully lowered position.

Another category of devices provide dynamic assistance to the lifter in that the lifter can safely relinquish control of the barbell at multiple points in the exercise. U.S. Pat. No. 5,273,506 to Dawson is typical of the most commonly used self spotting devices. This patent discloses a frame with two vertical posts wherein the barbell attaches to slides on the posts. By rotating the barbell about its longitudinal axis the lifter can lock the slides to the vertical posts at a plurality of positions. This type of device can provide assistance to the lifter at multiple points in the exercise. However, because the barbell is attached to slides that can only move in the vertical direction and not in any other, true free weight exercises cannot be done with this type of device.

U.S. Pat. No. 5,215,510 to Baran discloses a device somewhat similar to U.S. Pat. No. 4,757,998 described above with two major differences. The disclosed device has the two vertical posts with slides for attaching the barbell, but the vertical posts are attached to horizontal bars via slides that permit the vertical posts to move in the horizontal direction. Thus the barbell is free to move in the horizontal direction as well as the vertical direction. This is closer to true free weight movement but not quite since with true free weight lifting the barbell can move along three axis, this device permits movement along only two axis. Another difference in this patent is that it discloses no means for the lifter to lock the barbell to the vertical posts. The disclosed device is also quite complex mechanically in that six bearings are needed to support vertical and horizontal movement. The frictional resistance of these bearing plus the opposing inertial forces that result when barbell is accelerated, will reduce the proximity to true free weight lifting.

SUMMARY OF THE INVENTION

The invention in the present application is an apparatus for assisting a person to do free weight barbell exercises without the aid of a human spotter. The apparatus can be used for a variety of exercises without imposing movement restrictions in any axis, and without causing any forces to act on the barbell other than gravity. The invention permits the lifter to safely discontinue the exercise at any point in the exercise regardless of the position of the barbell.

In accordance with the invention, the apparatus comprises two vertical ropes, two rope clamps each of which attaches to a vertical rope and to a barbell, and a control bar that attaches to and controls the rope clamps. The ropes are attached to an overhead supporting structure at their upper ends and left free at their lower ends which terminate above floor level. The rope clamps attach firmly to the barbell and enclose the vertical ropes. The control bar is parallel to the barbell bar and a small distance above it. When the barbell is not in use by the lifter, the rope clamps grip the ropes and prevent the barbell from moving vertically. When the lifter wants to take control of the weight the lifter moves the control bar towards the barbell bar. The movement of the control bar causes the rope clamps to release the ropes thus permitting free movement of the barbell in any direction. To relinquish control of the barbell and transfer the weight to the vertical ropes, the lifter releases pressure on the control bar which causes the rope clamps to grip the ropes and support the barbell.

The instant invention maintains all the advantages of the static and dynamic devices described above and permits true free weight exercises by exerting no forces and exerting no movement constraints, in any axis, on the barbell during exercise. The invention permits the lifter to discontinue the exercise at any point in the exercise by simply releasing the control bar. The vertically guided apparatus in common use and as disclosed in the patents referred to above, permit discontinuance at discreet vertical points and require a twisting action to lock the slides bearing the barbell to the vertical posts.

The twisting action used with the vertically guided apparatus can put extreme stress on the lifter especially when the barbell weight is heavy in terms of the lifters capability and the lifter is in a fatigued state at the completion of the exercise.

The instant invention does not include any supporting benches or frames thus making it economical and flexible. The means of supporting the vertical ropes is not a part of this invention. Such means is dependent on the specific physical environment in which the invention is installed.

BRIEF DESCRIPTION OF THE DRAWINGS

For the purpose of illustrating the invention, there is shown in the drawings one form which is presently preferred; it being understood that the invention is not intended to be limited to the precise arrangements and instrumentalities shown.

REFERENCE NUMERALS IN DRAWINGS

Figure 1:
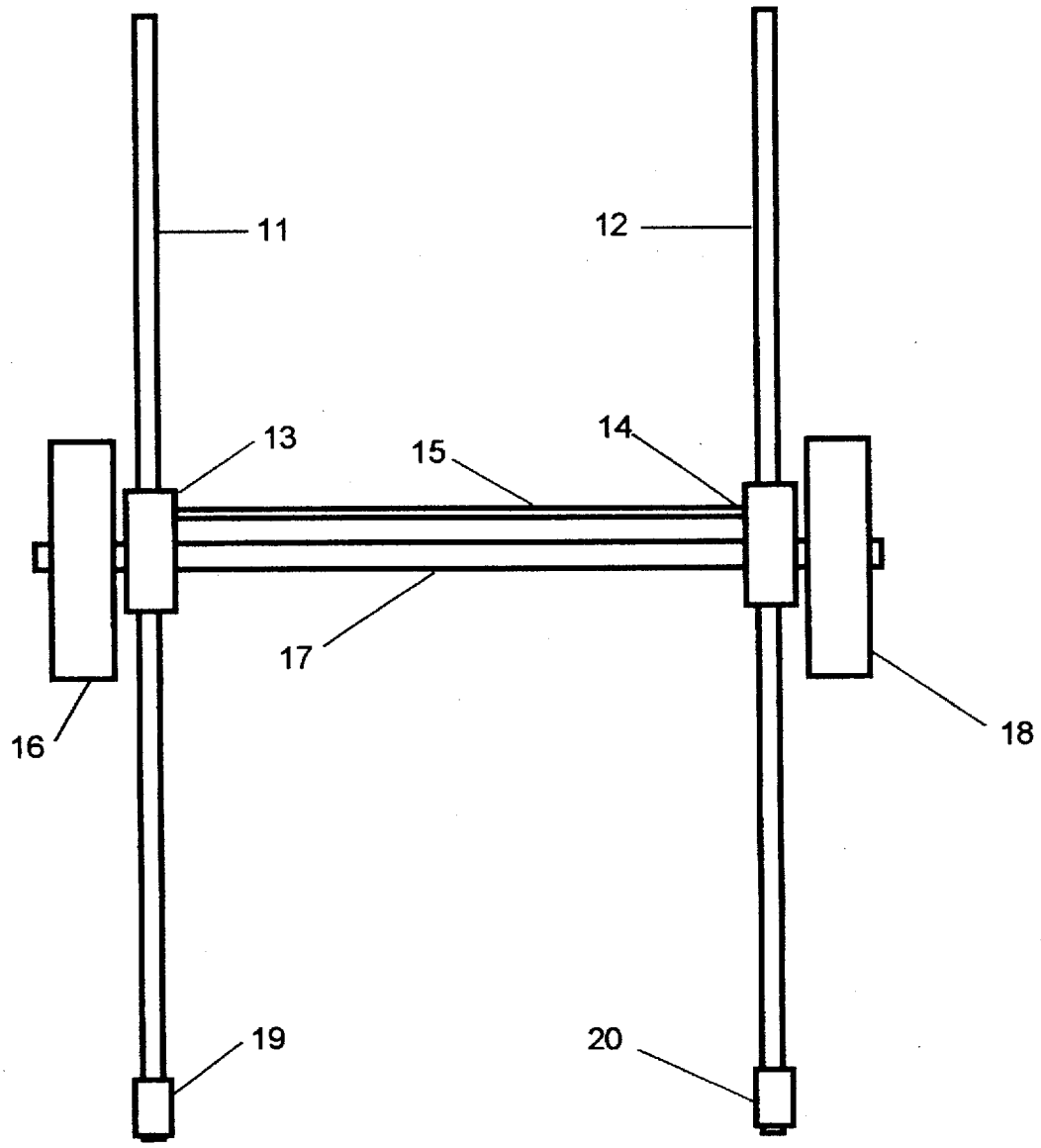
FIG. 1 is a view of the free weight self spotting apparatus in accordance with the principles of the present invention.

11 left suspension rope
12 right suspension rope
13 left clamp assembly
14 right clamp assembly
15 control bar
16 left weight plate
17 barbell bar
18 right weight plate
19 left anti snag weight
20 right anti snag weight
21 pivot bolt
22 bolt
23 bolt
24 front mounting plate
25 spacer
26 wedge plate
27 spring
28 counterweight
29 pivot pin
30 nut
31 left cam lobe
32 right cam lobe
33 cam cleat backplate
34 back mounting plate
35 nut
36 nut
37 u-bolt
38 hole
39 hole

DETAILED DESCRIPTION

A typical embodiment of the present invention is shown in FIG. 1. A horizontal barbell bar 17 with weight plates 16 and 18 at its distal ends is firmly attached to left clamp assembly 13 and right clamp assembly 14. The number and sizes of the weight plates is determined by the user at the time of use. A control bar 15 attaches to left clamp assembly 13 and right clamp assembly 14. Left and right clamp assemblies 13 and 14 enclose, in a telescoping manner, left suspension rope 11 and right suspension rope 12 respectively. The suspension ropes are secured at their upper ends by an unspecified means which could typically be ceiling beams and joists or a free standing frame. The suspension ropes are not secured at their lower ends. Left anti snag weight 19 and right anti snag weight 20 are small weights that provide sufficient tension on the suspension ropes to allow the ropes to pass smoothly through the clamp assemblies without snagging. These anti snag weights may or may not be required depending on the specific characteristics of the suspension ropes used.

Figure 2:
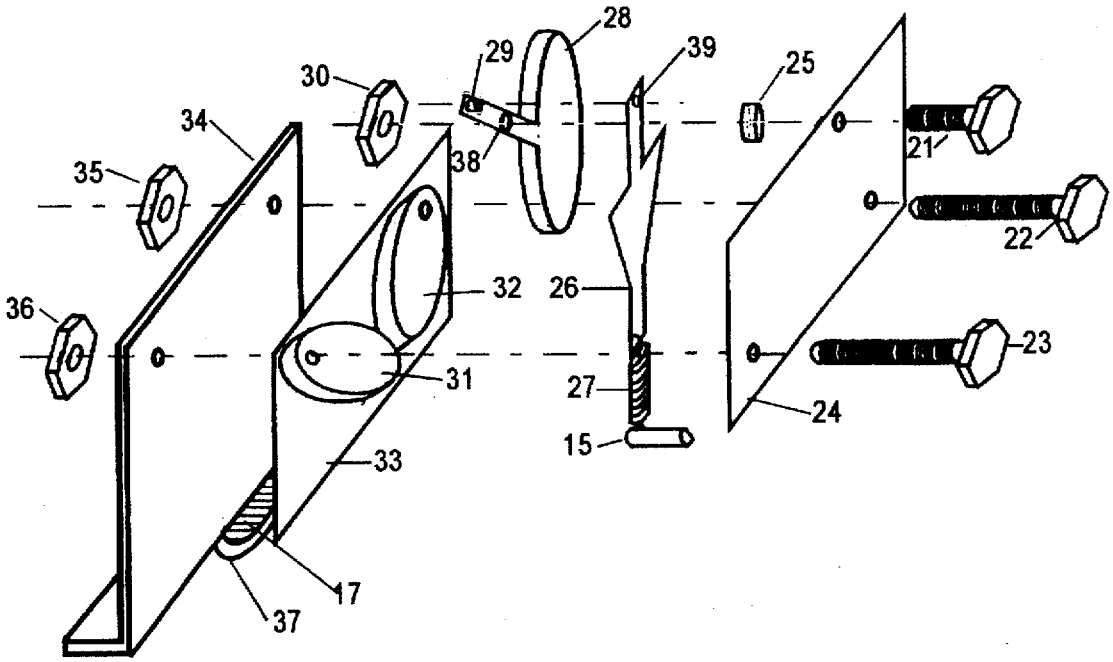
FIG. 2 is an isometric exploded view of the rope clamp assembly.

FIG. 2 is an exploded view of left clamp assembly Right clamp assembly 12 is identical in structure to left clamp assembly 13. The elements of the clamp assembly are mounted between the front mounting plate 24 and the back mounting plate 34. The cam cleat backplate 33, the left cam lobe 31, and the right cam lobe 32 comprise a single device known as a "cam cleat". Cam cleats are a commonly available device and commonly used device on sailboats. The cam lobes of a cam cleat are spring biased so that they are rotated towards each other.

The cam cleat assembly consisting of 31,32 and 33 is held in place between front mounting plate 24 and back mounting plate 34 by bolts 22 and 23 and nuts 35 and 36. In front of the cam cleat assembly is counterweight 28 which is attached to front mounting plate 24 by bolt 21, spacer 25, and nut 30. Bolt 21 passes through hole 38 on the counterweight 28. Counterweight 28 pivots about hole 38.

Wedge plate 26 attaches to counterweight 28 by means of hole 39 on wedge plate 26 and pivot pin 29 on counterweight 28. Wedge plate 26 pivots about hole 39. Control bar 15 is attached to wedge plate 26 by means of spring 27. Barbell bar 17 is attached to back mounting plate 34 by means of u-bolt 37.

Figure 3A:
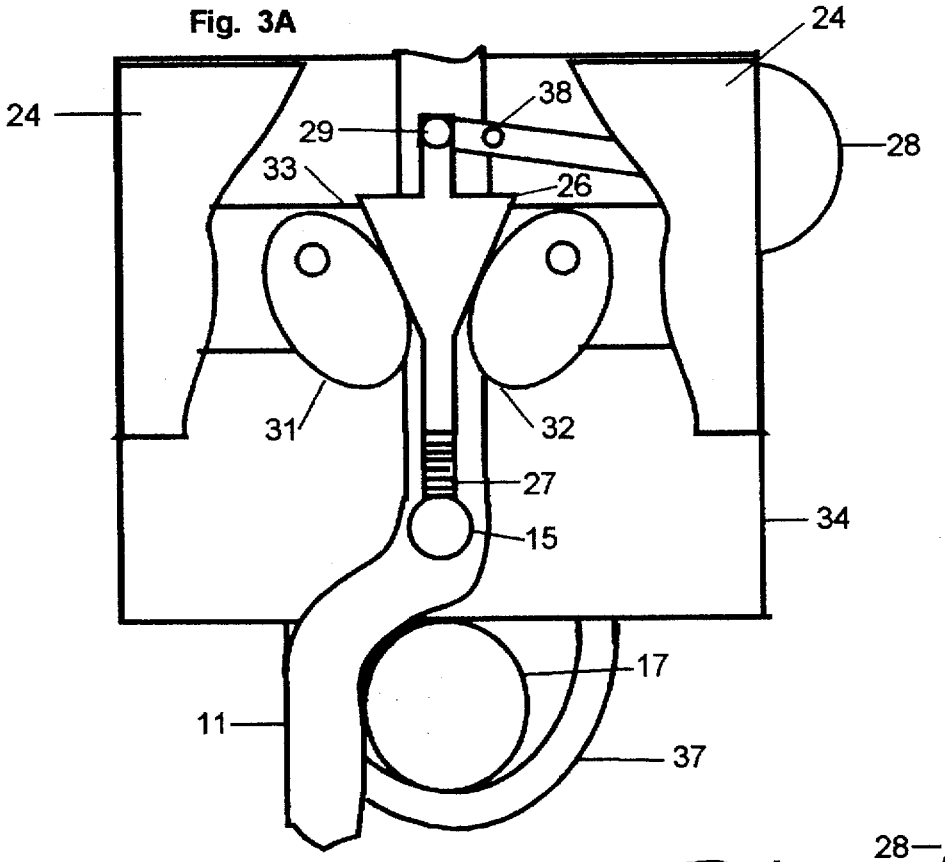
FIG. 3A is a cutaway front view of the rope clamp assembly showing the position of components when the rope is clamped to the clamp assembly.

FIG. 3A is a cutaway view of left clamp assembly 13 showing the position of components when the apparatus is not in use, i.e. rope 11 is clamped to clamp assembly 13. This view shows how the components of the assembly act together. When the apparatus is not in use wedge plate 26 is held above cam lobes 31 and 32 by counterweight 28 thus allowing the cam lobes to exert pressure against left suspension rope 11. This pressure prevents any relative movement between suspension rope 11 and left clamp assembly 13, therefore barbell bar 17 cannot move vertically downward.

Figure 3B:
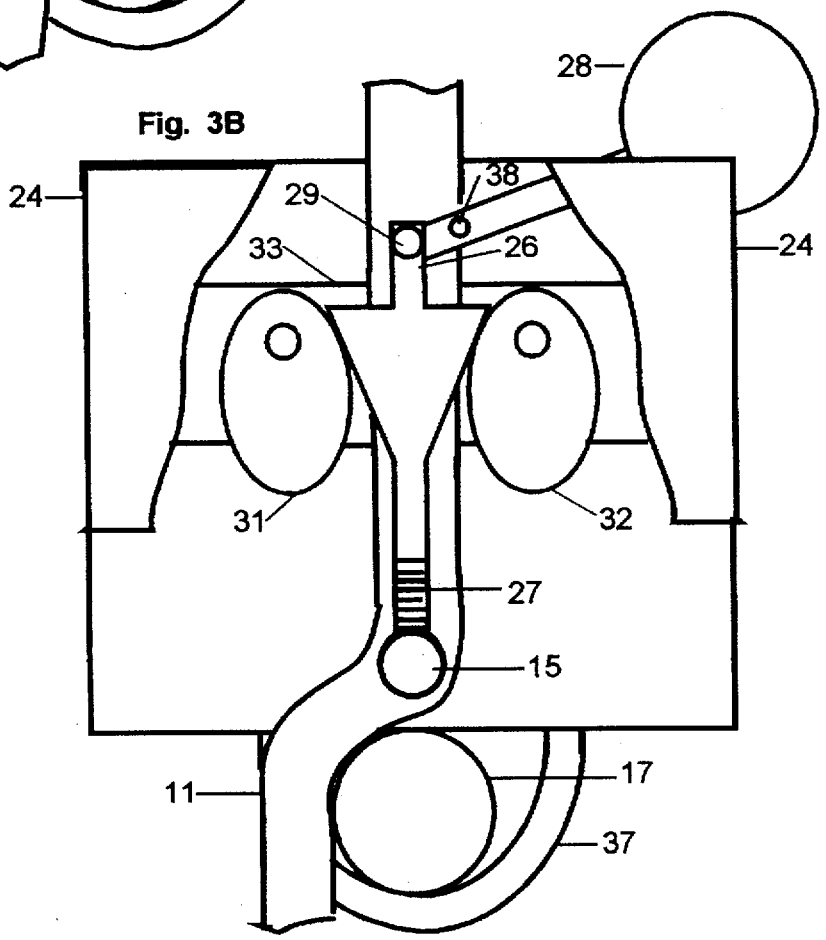
FIG. 3B is a cutaway front view of the rope clamp assembly showing the position of components when the rope is running free through the clamp assembly.

FIG. 3B shows the same view as FIG. 3A except the position of components applies to when the apparatus is in use, i.e. rope 11 runs free through clamp assembly 13. When the user moves control bar 15 downward towards barbell bar 17, wedge plate 26, being connected to control bar 15 by spring moves downward also. Wedge plate 26 contacts cam lobes and 32 forcing them apart. With cam lobes 31 and 32 forced apart, left suspension rope 11 can move freely through left clamp assembly 13, the barbell weight being born entirely by the user. The downward movement of wedge plate 26 causes counterweight 28 to rotate counterclockwise about hole because counterweight 28 is attached to wedge plate 26 by means of pivot pin 29 on counterweight 28. This movement of counterweight 28 stores potential energy for later retraction of wedge plate 26.

Spring 27 provides a built in safety feature. When cam lobes 31 and 32 are exerting pressure against left suspension rope 11, wedge plate 26 requires force to spread the cam lobes apart. Movement of control bar 15 downward will elongate spring 27 rather than moving wedge plate 26 downward. In order to move wedge plate 26 downward to spread cam lobes 31 an 32, the user must exert an upward force on barbell bar 17 to relieve the pressure cam lobes 31 and 32 are making against left suspension rope 11. When this pressure is relieved spring 27 will not elongate when control bar 15 is moved downward and thus wedge plate 26 will move downward and spread cam lobes 31 and 32 apart. This design prevents the barbell from being released when the weight is not under the control of the user.

When the user wishes to terminate the exercise the user releases control bar 15. When control bar 15 is released counterweight 28 pivots clockwise about hole 38 and raises wedge plate 26 via its pivot pin 29 connection to wedge plate 26. When wedge plate 26 is raised, cam lobes 31 and 32 are forced towards each other by internal cam cleat spring action, and grip left suspension rope 11.

Figure 4A:
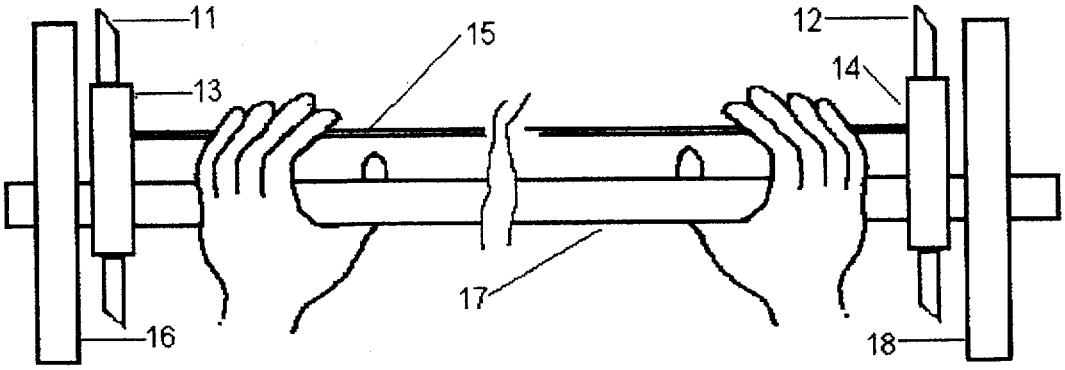
FIG. 4A is a view of control bar position when the barbell is supported by the vertical ropes.

FIG. 4A depicts the users hand position on control bar 15 when the weight is being born by the apparatus.

Figure 4B:
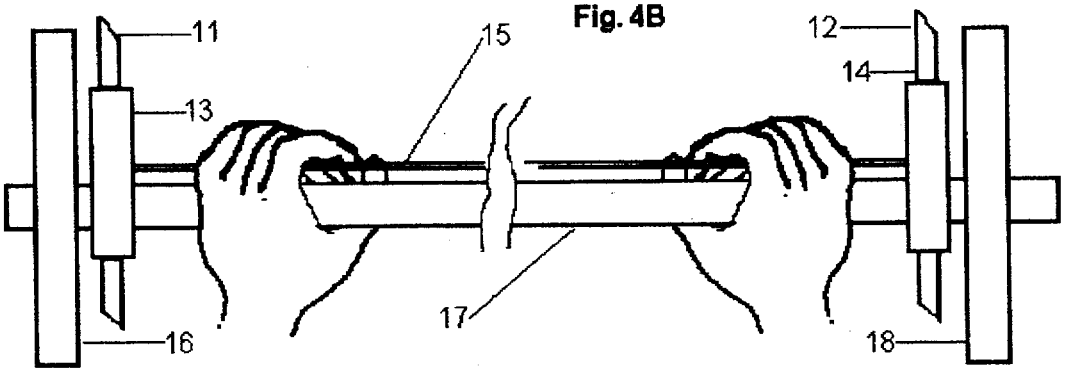
FIG. 4B is a view of the control bar position when the barbell is supported by the lifter.

FIG. 4B depicts the users hand position on the control bar 15 when the weight is being born by the user. As explained above, the user must exert an upward force on barbell bar 17 before clamp assemblies 13 and 14 can release their grip on suspension ropes 11 and 12.

Steel is the preferable material for all parts of the apparatus other than the cam cleats and the suspension ropes. There are numerous brands of cam cleats available, some are of metal construction others are made of non-metallic materials. The preferred suspension rope construction is braided synthetic fiber.

The present invention may be embodied in other specific forms without departing from the spirit or essential attributes thereof and accordingly reference should be made to the appended claims rather than to the forgoing specification as indicating the scope of the invention.

What is claimed is:

1. A weight lifting exercise apparatus for providing assistive support of a weight bar, the apparatus comprising:

means for supporting and maintaining at least one flexible elongate member in a substantially vertical orientation; said at least one flexible elongate member having an upper end and lower a lower end, the upper end secured to the supporting means;

clamping means mounted to said at least one flexible elongate member and having a clamped condition wherein the clamping means is secured to the at least one flexible elongate member so that there is no relative movement between the clamping means and the at least one flexible elongate member and a released condition wherein the clamping means is slidingly engaged to the at least one flexible elongate member to permit upward and downward movement of the clamping means relative to the substantially vertically oriented at least one flexible elongate member;

said clamping means including means to attach to the weight bar so that the weight bar and clamping means move together in upward and downward directions relative to said at least one flexible elongate member when said clamping means is in the released condition; and control means attached to said clamping means and positioned for engagement by a user, while the user is supporting the weight bar, to selectively select the clamping and released conditions of said clamping means, wherein the user selectively operates said control means to place said clamping means in the released condition to permit downward and upward movement of the weight bar relative to said at least one flexible elongate member, and wherein the user selectively operates said control means to place said clamping means in the clamped condition to prevent downward movement of the weight bar relative to said at least one flexible elongate member.

2. The weight lifting exercise apparatus of claim 1 wherein said at least one flexible elongate member comprises rope of synthetic fiber material.

3. The weight lifting exercise apparatus of claim 1 wherein the lower end of said at least one flexible elongate member carries an anti-snag weight.

4. The weight lifting exercise apparatus of claim 1 wherein said at least one flexible elongate member comprises a first and a second flexible elongate member, the means for supporting said at least one flexible elongate member supports said first and second flexible elongate members in a separated relation from each other by a distance permitting both hands of the user to engage the weight bar between said first and second flexible elongate members; and said clamping means comprises a first and a second clamping means mounted to respective first and second flexible elongate members.

5. The weight lifting exercise apparatus of claim 4 wherein said control means comprises a control bar spanning the distance between the first and second clamping means, said control bar positioned substantially parallel to a longitudinal axis of the weight bar and proximate the weight bar, wherein the user moves said control bar toward the weight bar to place said first and second clamping means in the released condition and the user releases said control bar to place said first and second clamping means in the clamped condition.

6. The weight lifting exercise apparatus of claim 1 wherein said clamping means comprises a cam cleat assembly;

said cam cleat assembly including a pair of pivotal cams pivotally attached to a housing of said cam cleat assembly, said at least one flexible elongate member passing between said pair of pivotal cams, wherein said pair of pivotal cams cooperatively pivot in a first direction to engage said at least one flexible elongate member in the clamped condition and said pair of pivotal cams cooperatively pivot in a second direction to disengage from said at least one flexible elongate member in the released condition.

7. The weight lifting exercise apparatus of claim 6 wherein said clamping means further comprises a wedge connected to said control means and engaging said pair of pivotal cams, said wedge positioned by said control means to a raised position to permit said pair of cams to cooperatively pivot in the first direction to engage said at least one flexible elongate member in the clamped condition and said wedge positioned by said control means to a lowered position to cooperatively pivot said pair of pivotal cams in the second direction to disengage said pair of pivotal cams from said at least one flexible elongate member.

8. The weight lifting exercise apparatus of claim 7, wherein said clamping means further comprises a counterweight connected to said wedge to bias said wedge to the raised position when said clamping means is in the released condition.

* * * * *